US009388697B2

(12) United States Patent
Fernandez et al.

(10) Patent No.: US 9,388,697 B2
(45) Date of Patent: Jul. 12, 2016

(54) FIRST STAGE COMPRESSOR DISK CONFIGURED FOR BALANCING THE COMPRESSOR ROTOR ASSEMBLY

(75) Inventors: Dover M. Fernandez, Chula Vista, CA (US); Cory Patrick Muscat, Poway, CA (US); Gary Paul Vavrek, San Diego, CA (US); James Eric Miller, El Cajon, CA (US)

(73) Assignee: Solar Turbines Incorporated, San Diego, CA (US)

( * ) Notice: Subject to any disclaimer, the term of this patent is extended or adjusted under 35 U.S.C. 154(b) by 979 days.

(21) Appl. No.: 13/551,517

(22) Filed: Jul. 17, 2012

(65) Prior Publication Data

US 2014/0023504 A1 Jan. 23, 2014

(51) Int. Cl.
*F01D 5/02* (2006.01)
*F01D 5/06* (2006.01)

(52) U.S. Cl.
CPC ..... *F01D 5/027* (2013.01); *F01D 5/063* (2013.01); *Y10T 29/49321* (2015.01)

(58) Field of Classification Search
CPC ..... F16F 15/322; F16F 15/34; F01D 5/063; F01D 5/027
See application file for complete search history.

(56) References Cited

U.S. PATENT DOCUMENTS

| | | | | |
|---|---|---|---|---|
| 4,716,761 | A | 1/1988 | Ito et al. | |
| 6,171,195 | B1 * | 1/2001 | Ferguson | 464/137 |
| 6,422,809 | B1 | 7/2002 | Filippov et al. | |
| 6,471,453 | B1 * | 10/2002 | Winebrenner et al. | 409/141 |
| 7,347,672 | B2 * | 3/2008 | Bertrand et al. | 416/145 |
| 8,186,954 | B2 * | 5/2012 | Lee | F01D 5/027 416/144 |
| 8,342,804 | B2 * | 1/2013 | Pronovost | F01D 5/027 416/144 |
| 8,888,458 | B2 * | 11/2014 | Billings | F01D 5/027 416/144 |
| 2004/0156708 | A1 * | 8/2004 | Allam | 415/144 |
| 2005/0191181 | A1 | 9/2005 | Bertrand et al. | |
| 2009/0087313 | A1 * | 4/2009 | Belmonte et al. | 416/144 |
| 2009/0123282 | A1 * | 5/2009 | Buskirk et al. | 416/1 |
| 2010/0028155 | A1 * | 2/2010 | Nishioka et al. | 416/223 A |
| 2010/0074752 | A1 | 3/2010 | Denis et al. | |
| 2010/0080705 | A1 * | 4/2010 | Pronovost et al. | 416/144 |
| 2010/0296937 | A1 | 11/2010 | Bestwick | |
| 2010/0296938 | A1 * | 11/2010 | Nishimoto et al. | 416/223 A |
| 2012/0151937 | A1 * | 6/2012 | Muscat et al. | 60/805 |
| 2012/0207603 | A1 * | 8/2012 | Woods et al. | 416/145 |
| 2014/0140849 | A1 * | 5/2014 | Muscat et al. | 416/144 |

FOREIGN PATENT DOCUMENTS

| | | | |
|---|---|---|---|
| CN | 102046960 | | 5/2011 |
| EP | 1 602 855 | A2 | 12/2005 |
| GB | 2454569 | | 5/2009 |
| JP | 60032901 | A | 2/1985 |
| SU | 624130 | A1 | 9/1978 |

* cited by examiner

*Primary Examiner* — Craig Kim
*Assistant Examiner* — Jason Fountain
(74) *Attorney, Agent, or Firm* — Procopio, Cory, Hargreaves & Savitch LLP

(57) ABSTRACT

A first stage compressor disk of a gas turbine engine includes a body. The body includes a forward end, an aft end, and an outer surface. The body also includes a plurality of forward balancing holes through the outer surface. The forward balancing holes align circumferentially about the body. The body further includes a plurality of aft balancing holes through the outer surface. The aft balancing holes align circumferentially about the body and are located aft of the forward balancing holes. The first stage compressor disk also includes a radial flange at the aft end of the body. The radial flange extends radially outward from the body. The radial flange includes slots for mounting airfoils.

20 Claims, 6 Drawing Sheets

FIRST STAGE COMPRESSOR DISK CONFIGURED FOR BALANCING THE COMPRESSOR ROTOR ASSEMBLY

TECHNICAL FIELD

The present disclosure generally pertains to gas turbine engines, and is more particularly directed toward a first stage compressor disk configured for balancing the compressor rotor assembly of a gas turbine engine.

BACKGROUND

Gas turbine engines include compressor, combustor, and turbine sections. Rotating components of the gas turbine engine may need to be balanced due to limitations in component manufacturing. In particular the compressor rotor assembly may need to be balanced to reduce vibrations in the gas turbine engine. Larger compressor rotor assemblies may use a dynamic balancing system and method for balancing to reduce vibration and increase component reliability.

E.P. Patent Ser. No. 1,602,855, to J. Przytulski, discloses a balance assembly for rotary turbine components. The balance assembly comprises a balance weight retention member having a circumferential periphery and a slot formed therein. The slot has a bottom surface, an opening, and a pair of spaced apart and opposed side walls. The side walls sloping inwardly between the bottom surface and the opening. The balance assembly also comprises at least one balance weight configured and sized to be insertable through the opening of the slot and to be positionable for movement within the slot and having a pair of spaced apart inwardly sloping shoulder surfaces capable of engaging the side walls of the slot. The balance assembly further comprises a balance weight securing member associated with the at least one balance weight.

The present disclosure is directed toward overcoming one or more of the problems discussed above as well as additional problems discovered by the inventors.

SUMMARY OF THE DISCLOSURE

A first stage compressor disk of a gas turbine engine includes a body. The body includes a forward end, an aft end, and an outer surface. The body also includes a plurality of forward balancing holes through the outer surface. The forward balancing holes align circumferentially about the body. The body further includes a plurality of aft balancing holes through the outer surface. The aft balancing holes align circumferentially about the body and are located aft of the forward balancing holes. The first stage compressor disk also includes a radial flange at the aft end of the body. The radial flange extends radially outward from the body. The radial flange includes slots for mounting airfoils.

A method for balancing a compressor rotor assembly of a gas turbine engine. The compressor rotor assembly includes compressor disks. The compressor disks include slots for mounting airfoils. The compressor disks also include a first stage compressor disk. The first stage compressor disk includes a body with an outer surface. The compressor rotor assembly also includes a balancing system with a plurality of forward balancing holes extending through the outer surface and distributed circumferentially about the body, and a plurality of aft balancing holes extending through the outer surface and distributed circumferentially about the body. The aft balancing holes are located aft of the forward balancing holes. The mounting system also including a plurality of weights. The compressor rotor assembly further includes a plurality of airfoils.

The method includes measuring the rotational balance of a forward weldment. The method also includes determining the number of weights, the size of each weight, and the desired location within the balancing system for each of the determined weights based upon the measured rotational balance of the forward weldment. The method also includes mounting each weight in the determined location. The method also includes fastening the forward weldment to an aft weldment. The method also includes measuring the rotational balance of the compressor rotor assembly and weighing the plurality of airfoils. The method also includes determining the number of weights, the size of each weight, the desired location in the balancing system for each of the determined weights based upon the measured rotational balance of the compressor rotor assembly, and the desired slot to receive each airfoil based upon the measured rotational balance of the compressor rotor assembly. The method further includes mounting each weight in the determined location and mounting each airfoil in the determined slot.

DETAILED DESCRIPTION

Figure 1:
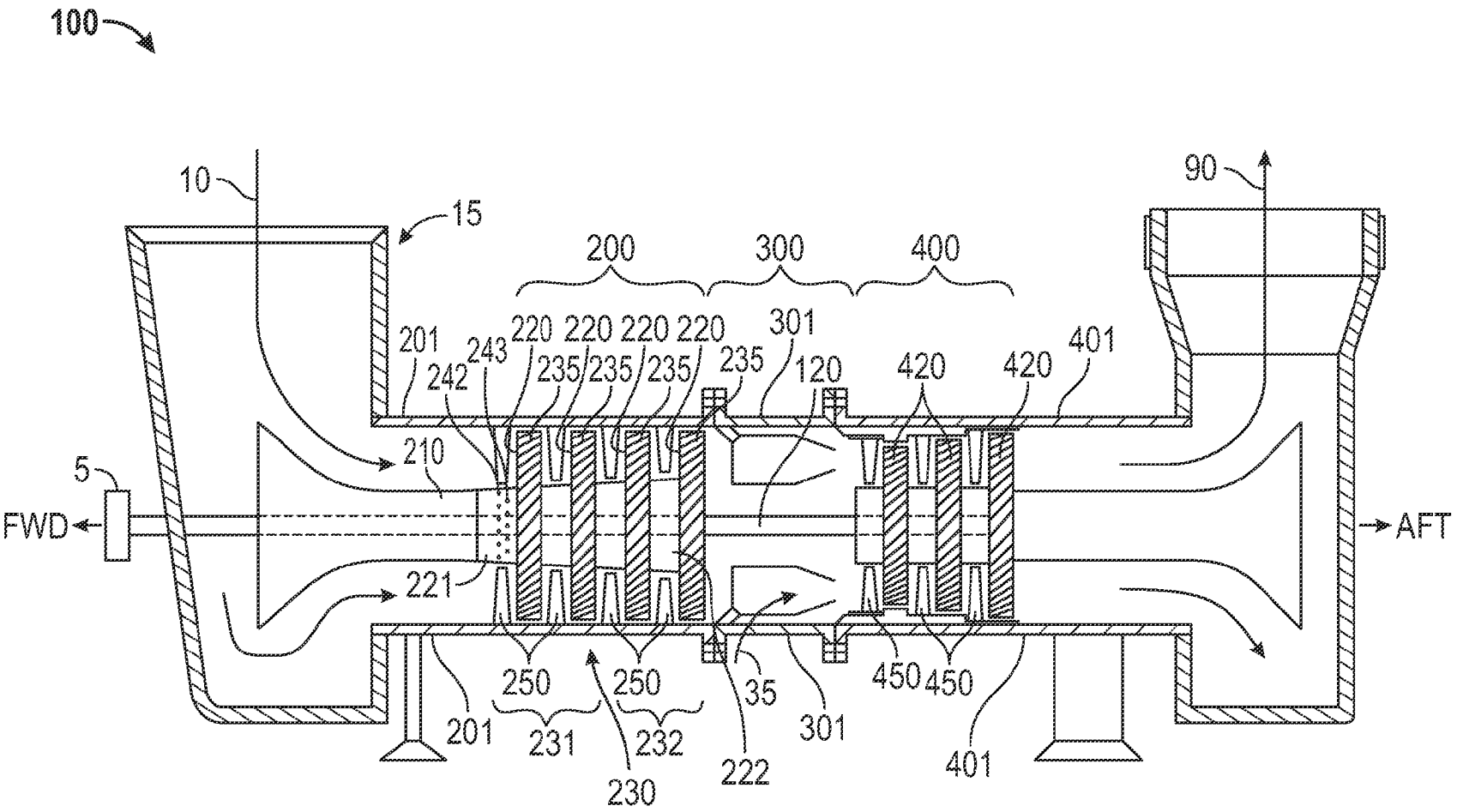
FIG. 1 is a schematic illustration of an exemplary gas turbine engine.

FIG. 1 is a schematic illustration of an exemplary gas turbine engine. A gas turbine engine 100 typically includes a compressor 200, a combustor 300, and a turbine 400. Air 10 enters an inlet 15 as a "working fluid" and is compressed by the compressor 200. Fuel 35 is added to the compressed air in the combustor 300 and then ignited to produce a high energy combustion gas. Energy is extracted from the combusted fuel/air mixture via the turbine 400 and is typically made usable via a power output coupling 5. The power output coupling 5 is shown as being on the forward side of the gas turbine engine 100, but in other configurations it may be provided at the aft end of gas turbine engine 100. Exhaust 90 may exit the system or be further processed (e.g., to reduce harmful emissions or to recover heat from the exhaust).

The compressor 200 includes a compressor rotor assembly 230. The compressor rotor assembly 230 includes a forward weldment 231. The forward weldment 231 includes a first plurality of compressor disks 220, wherein the first stage compressor disk 221 is the most forward compressor disk 220. The first stage compressor disk 221 includes a plurality of forward balancing holes 242 and a plurality of aft balancing holes 243. The first stage compressor disk 221 may be welded to one or more subsequent compressor disks 220 to comprise the forward weldment 231.

The compressor rotor assembly 230 also includes the aft weldment 232. The aft weldment includes a second plurality of compressor disks 220, wherein the last stage compressor disk 222 is the most aft compressor disk 220. The last stage compressor disk 222 may be welded to one or more of the preceding compressor disks 220 to comprise the aft weldment 232. The compressor disks 220 of the forward weldment 231 and the aft weldment 232 are mechanically coupled to the shaft 120. The forward weldment 231 and the aft weldment 232 are fastened together. The compressor rotor assembly 230 further includes a plurality of compressor rotor blades ("airfoils") 235 that circumferentially populate the compressor rotor disks 220.

The turbine 400 includes one or more turbine rotor assemblies 420 mechanically coupled to the shaft 120. The turbine 400 may have a single shaft or a dual shaft configuration. The compressor rotor assembly 230 and the turbine rotor assemblies 420 are axial flow rotor assemblies. Each turbine rotor assembly 420 includes a rotor disk that is circumferentially populated with a plurality of turbine rotor blades.

Compressor stationary vanes ("stator vanes" or "stators") 250 may axially precede each of the compressor rotor disks 220 populated with airfoils 235. Turbine nozzles 450 may axially precede each of the turbine rotor assemblies 420. The turbine nozzles 450 have circumferentially distributed turbine nozzle vanes. The turbine nozzle vanes helically reorient the combustion gas that is delivered to the rotor blades of the turbine rotor assemblies 420 where the energy in the combustion gas is converted to mechanical energy and rotates the shaft 120.

The various components of the compressor 200 are housed in a compressor case 201 that may be generally cylindrical. The various components of the combustor 300 and the turbine 400 are housed, respectively, in a combustor case 301 and a turbine case 401. The forward hub 210 is fastened to the first stage compressor disk 221.

Figure 2:
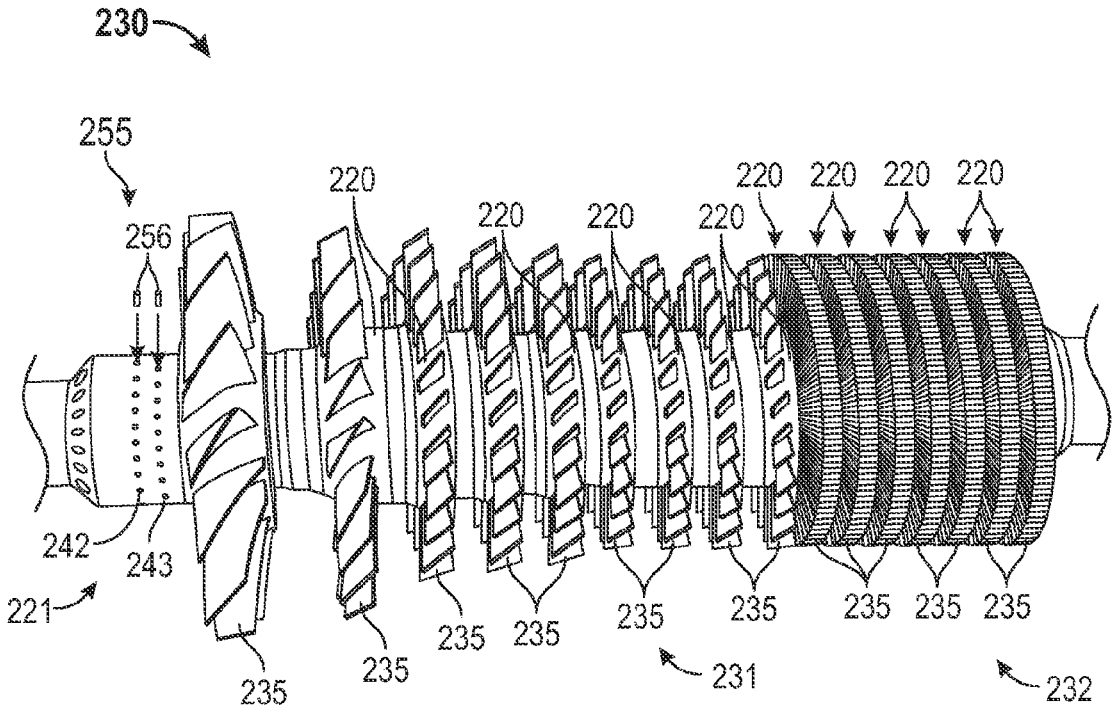
FIG. 2 is a perspective view of the compressor rotor assembly.

FIG. 2 is a perspective view of the compressor rotor assembly 230. Unless noted, the description and numbering used in connection with FIG. 1 applies to the embodiment depicted in FIG. 2. The compressor rotor assembly 230 may include a balancing system 255. The balancing system may include the plurality of forward balancing holes 242 and the plurality of aft balancing holes 243. A first group of balancing holes may be selected from the forward balancing holes 242 and the aft balancing holes 243. The remaining forward balancing holes 242 and aft balancing holes 243 may comprise a second group of balancing holes. Alternatively, the forward balancing holes 242 may comprise the first group of balancing holes and the aft balancing holes 243 may comprise the second group of balancing holes.

Balancing system 255 may also include weights 256. Weights 256 may have various sizes, masses, and lengths. In an exemplary embodiment weights 256 have a ⅜ inch diameter and lengths of ¼ inch, ½ inch, or ¾ inch. Alternatively, other diameters may be used. Balancing system 255 may further include airfoils 235. Airfoils 235 sizes may be determined by the sizes of the compressor disks 220.

Figure 3:
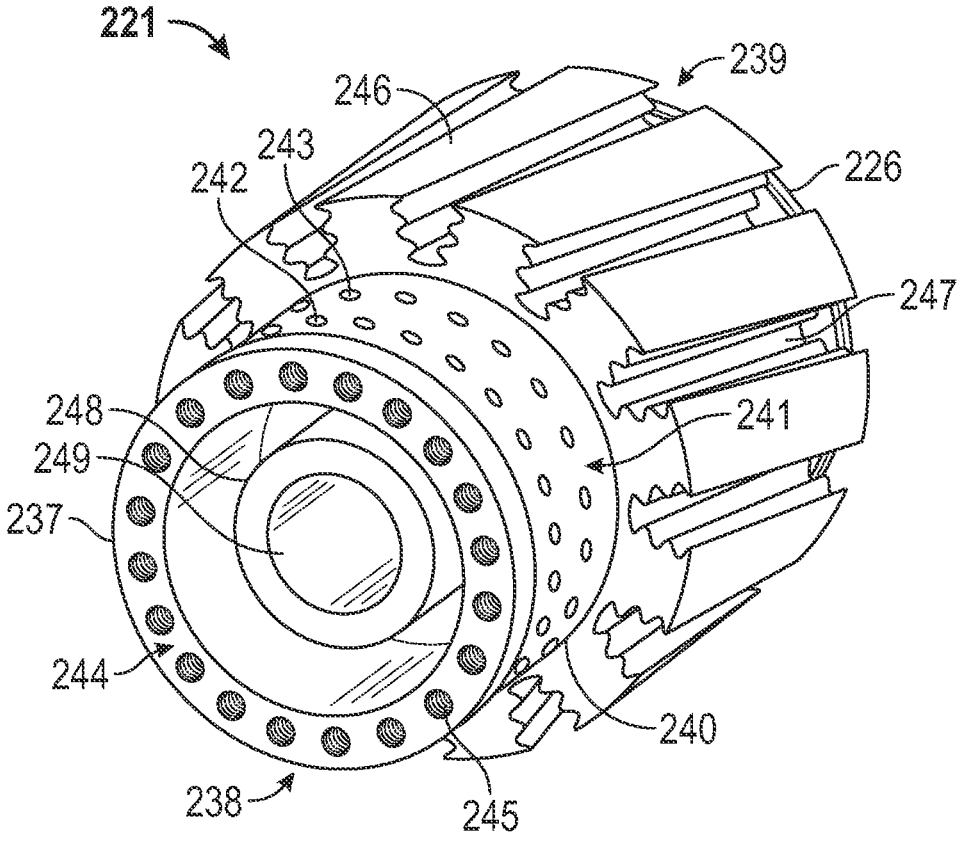
FIG. 3 is a perspective view of the first stage compressor disk.

FIG. 3 is a perspective view of the first stage compressor disk 221 of a gas turbine engine such as the engine depicted in FIG. 1. The first stage compressor disk 221 includes a body 240. The body 240 may have an annular shape with a forward end 238 and an aft end 239. The body 240 may include the outer axial flange 237. The outer axial flange 237 may extend from the body 240 axially forward. The body 240 may also include the outer surface 241 that extends from the forward end 238 towards the aft end 239 of the body 240. A portion of the outer surface 241 may be on the outer axial flange 237.

The body 240 includes the plurality of forward balancing holes 242 which extend through the outer surface 241. Each forward balancing hole 242 extends radially inward from the outer surface 241. The forward balancing holes 242 may be aligned circumferentially and evenly spaced about the body 240. The body 240 also includes the plurality of aft balancing holes 243 which extend through the outer surface 241. Each aft balancing hole 243 extends radially inward from the outer surface 241. The aft balancing holes 243 may be aligned circumferentially and evenly spaced about the body 240. The aft balancing holes 243 may also be shifted axially aft of the forward balancing holes 242 and may be circumferentially offset or clocked relative to the forward balancing holes 242.

The forward balancing holes 242 and the aft balancing holes 243 may be located near the center of gravity of the first stage compressor disk 221. The aft balancing holes 243 may be closer to the center of gravity of the first stage compressor disk 221 than the forward balancing holes 242. The forward balancing holes 242 and the aft balancing holes 243 may be threaded. In one embodiment the holes have a ⅜ inch diameter. Alternatively, other diameters may be used.

The forward balancing holes 242 may total more than twelve and less than thirty. The aft balancing holes 243 may total more than twelve and less than thirty. The number of forward balancing holes 242 and aft balancing holes 243 may correspond with the diameter of the body 240 or may correspond with the number of slots 247 in the first stage compressor disk 221. The aft balancing holes 243 may be circumferentially offset or clocked by half of the angular distance between adjacent forward balancing holes 242. The depth of the forward balancing holes 242 and the aft balancing holes 243 may correspond with the size of the weights 256 of the balancing system 255.

In one embodiment the forward balancing holes 242 may total twenty-four, the aft balancing holes 243 may total twenty-four, and the aft balancing holes 243 may be circumferentially offset or clocked 7.5 degrees relative to the forward balancing holes 242. The aft balancing holes 243 may be shifted 1.5 inches axially aft of the forward balancing holes 242. In another embodiment the aft balancing holes 243 may be at least 0.75 inches deep.

The body 240 may also include the forward surface 244 at the forward end 238. The forward surface 244 may be adjacent to the outer surface 241 and may be on the outer axial flange 237. The body 240 may further include a plurality of hub mounting holes 245 which extend through the forward surface 244. The hub mounting holes 245 may extend aft from the forward surface 244. The hub mounting 245 holes may be in the outer axial flange 237.

The body 240 may also include an inner axial flange 248. The inner axial flange 248 may extend axially forward from the forward end 238 of the body 240. The inner axial flange 248 may be located within the outer axial flange 237.

The first stage compressor disk 221 also includes a radial flange 246. The radial flange 246 may extend radially outward from the aft end 239 of the body 240. The radial flange 246 may include a plurality of slots 247 configured for mounting airfoils 235 to the first stage compressor disk 221. The slots 247 may have a fir tree cross-sectional shape.

The first stage compressor disk 221 may also include an aft welding member 226. The aft welding member 226 may have an annular shape and may extend aft from the body 240.

The first stage compressor disk 221 may further include a bore 249. The bore 249 may extend from the inner axial flange 248 at the forward end 238, through the body 240, and through the aft end 239. The shaft 120 may pass through the bore 249 of the first stage compressor disk 221 as illustrated in FIG. 1.

Figure 4:
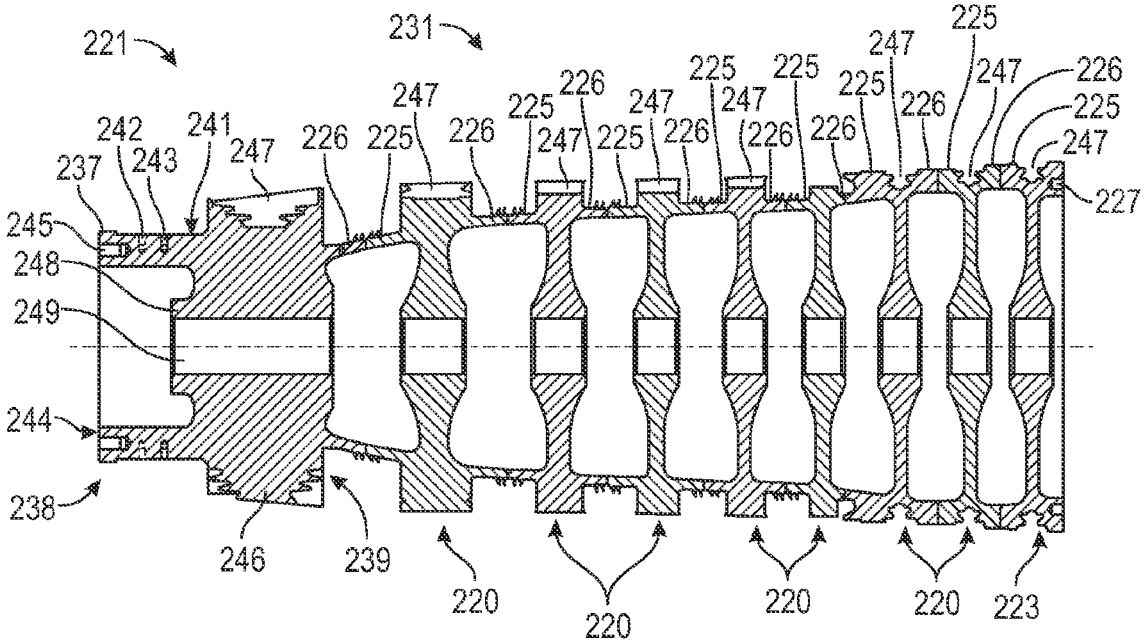
FIG. 4 is a cross-sectional view of a forward weldment.

FIG. 4 is a cross-sectional view of a forward weldment 231 including the first stage compressor disk 221 depicted in FIG. 3. Unless noted, the description and numbering used in connection with FIG. 2 and FIG. 3 apply to the embodiment depicted in FIG. 4 and the description and numbering used in connection with FIG. 4 applies to the embodiment depicted in FIG. 2 and FIG. 3. The forward weldment 231 includes a first plurality of compressor disks 220. Each compressor disk 220 includes slots 247 for mounting airfoils 235. This plurality includes the first stage compressor disk 221 and the forward fastening compressor disk 223. The first stage compressor disk 221 includes the forward balancing holes 242 (the outline of two forward balancing holes are shown with dashed lines in FIG. 4) and the aft balancing holes 243. The forward fastening compressor disk 223 may include a forward welding member 225. The forward welding member 225 may have an annular shape and may extend forward from the forward fastening compressor disk 223. The forward fastening compressor disk 223 may also include a plurality of forward weldment mounting holes 227. The forward weldment mounting holes 227 may be located on an aft end of the forward fastening compressor disk 223 and may extend axially forward.

The compressor disks 220 not located at the forward or aft end of the forward weldment may include a forward welding member 225 and an aft welding member 226. The forward welding member 225 may have an annular shape and may extend forward from the compressor disk 220. The aft welding member 226 may have an annular shape and may extend aft from the compressor disk 220. The aft welding member 226 of the first stage compressor disk 221 may be welded to the forward welding member 225 of the subsequent compressor disk 220. Each subsequent compressor disk 220 may be welded to the previous compressor disk 220 in a similar manner. The forward fastening compressor disk 223 may also be welded to the previous compressor disk 220 in a similar manner. In one embodiment the forward weldment 231 may include nine compressor disks 220; the forward fastening compressor disk 223 may be the ninth stage compressor disk.

Figure 5:
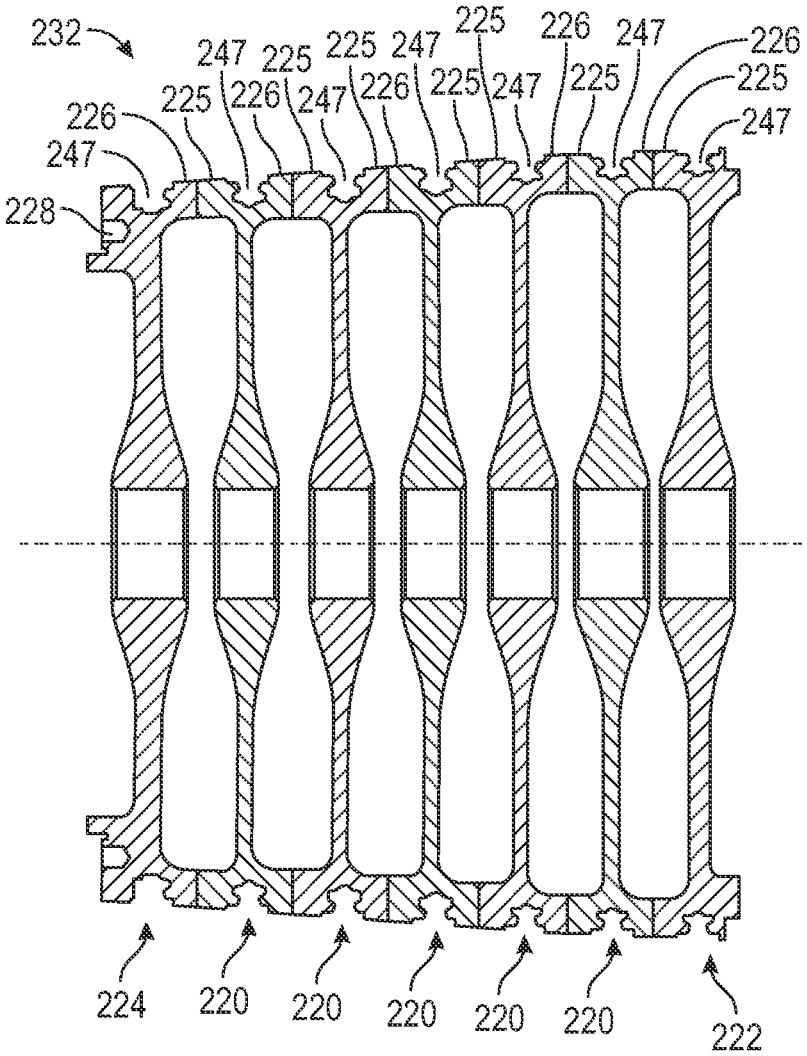
FIG. 5 is a cross-sectional view of an aft weldment.

FIG. 5 is a cross-sectional view of an aft weldment 232. Unless noted, the description and numbering used in connection with FIG. 2 and FIG. 4 apply to the embodiment depicted in FIG. 5 and the description and numbering used in connection with FIG. 5 applies to the embodiment depicted in FIG. 2 and FIG. 4. The aft weldment 232 includes a second plurality of compressor disks 220. Each compressor disk 220 includes slots 247 for mounting airfoils 235. This plurality includes the last stage compressor disk 222 and the aft fastening compressor disk 224. The aft fastening compressor disk 224 may include an aft welding member 226. The aft welding member 226 may have an annular shape and may extend aft from the aft fastening compressor disk 224. The aft fastening compressor disk 224 may also include a plurality of aft weldment mounting holes 228. The aft weldment mounting holes 228 may be located on a forward end of the aft fastening compressor disk 224 and may extend axially aft.

The aft welding member 226 of the aft fastening compressor disk 224 may be welded to the forward welding member 225 of the subsequent compressor disk 220. Each subsequent compressor disk 220 may be welded to the previous compressor disk 220 in a similar manner. The last stage compressor disk 222 may also be welded to the previous compressor disk 220 in a similar manner. In one embodiment the aft weldment 232 may include seven compressor disks 220; the aft fastening compressor disk 224 may be the tenth stage compressor disk and the last stage compressor disk 222 may be the sixteenth stage compressor disk.

INDUSTRIAL APPLICABILITY

Gas turbine engines and other rotary machines include a number of rotating elements. An imbalanced rotating element may cause vibration when rotating. Vibration in a rotating element may cause undesirable stresses in the rotating element. The stresses caused by the vibration may cause a fatigue failure in the rotating element or other related elements. Excessive vibration may reduce the reliability, may cause high bearing thrusts, and may lead to component failures. In a gas turbine engine excessive vibration may also cause the shaft to bend or suffer from fatigue failure.

Through extensive research and testing it was determined that some larger gas turbine engines may need to include a more dynamic balancing system and method. A dynamic balancing method may be accomplished in an efficient manner by limiting the number of components used in the balancing system 255. Balancing system 255 may reduce the imbalance of the gas turbine engine leading to less vibration and quieter operation.

In particular, it was determined that the balancing system 255 including a first stage compressor disk 221 with a plurality of forward balancing holes 242 and a plurality of aft balancing holes 243 may reduce vibration and may increase the reliability of the compressor rotor assembly 230, the shaft 120, and the associated bearings among other components.

Through research and development the location of the forward balancing holes 242 and the aft balancing holes 243 were determined. Misplacement of the forward balancing holes 242 and the aft balancing holes 243 may reduce the fatigue strength of the first stage compressor disk 221 and may reduce the overall reliability of the first stage compressor disk 221. Variations in the cross-section throughout the first stage compressor disk 221, such as variations resulting from the forward balancing holes 242 and aft balancing holes 243, may lead to stress concentrations. These stress concentrations may cause cracking in the first stage compressor disk 221.

Figure 6:
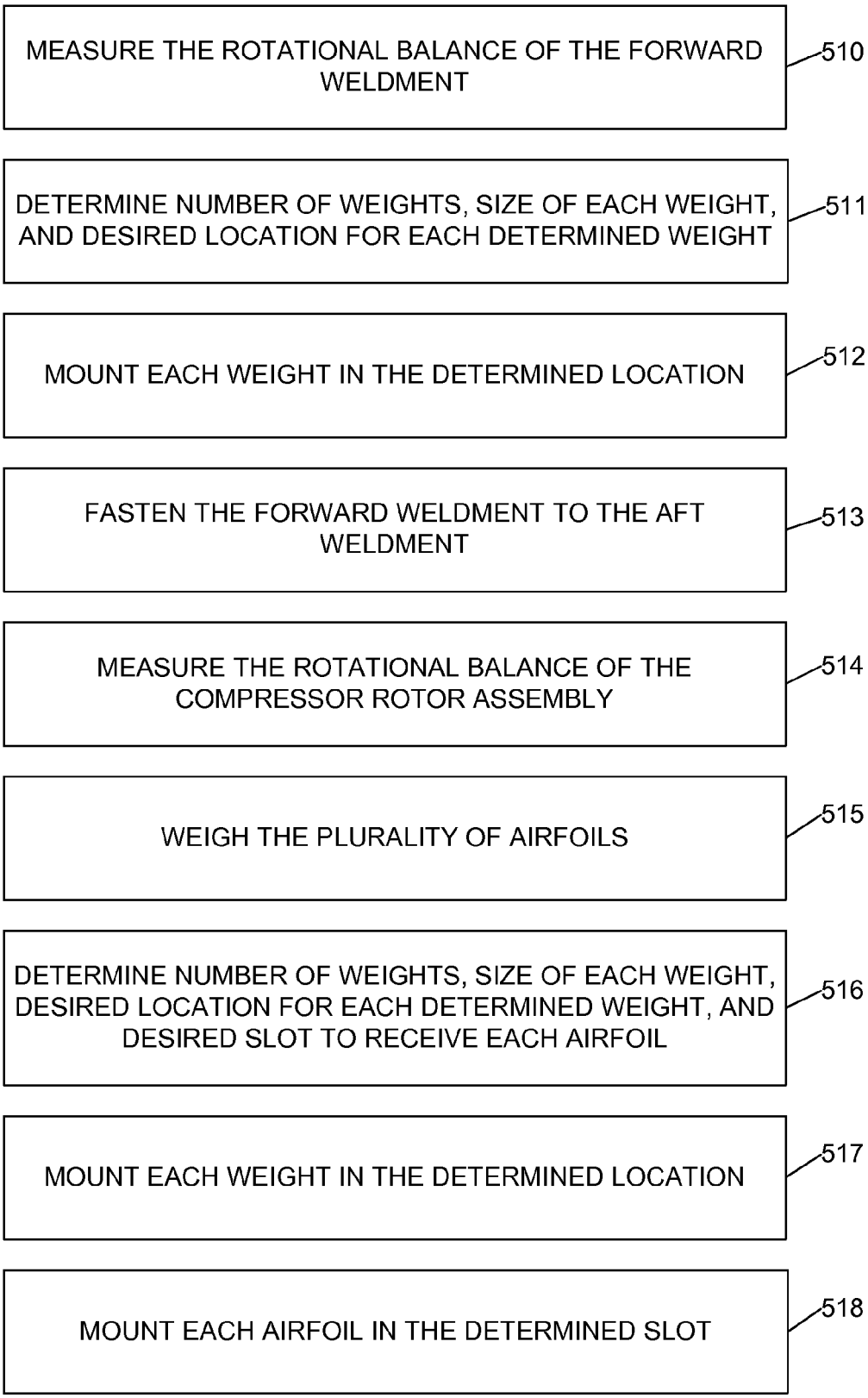
FIG. 6 is a flowchart of a method for balancing a compressor assembly.

FIG. 6 is a flowchart of a method for balancing the compressor rotor assembly 230. Balancing the compressor rotor assembly 230 may comprise using the balancing system 255. The compressor rotor assembly 230 shown in FIG. 2 includes the forward weldment 231 of FIG. 4, the aft weldment 232 of FIG. 5, and the plurality of airfoils 235 as illustrated in FIG. 2. Balancing the compressor rotor assembly 230 may include step 510, measuring the rotational balance or imbalance of the forward weldment 231 with a balancing machine.

Balancing the compressor rotor assembly 230 may also include step 511, determining the number of weights 256, the size of each weight 256, and the desired location for each of the determined weights 256 based upon the measured rotational balance of the forward weldment 231. The location for each weight 256 may be in a forward balancing hole 242 or in an aft balancing hole 243. Either the first group of balancing holes or the second group of balancing holes may be used. In an exemplary embodiment, weights 256 may be ¼ inch, ½ inch, or ¾ inch in length. Step 511 may be accomplished using the balancing machine.

Balancing the compressor rotor assembly 230 may further include step 512, mounting each weight 256 in the determined location. In one embodiment ¼ inch, ½ inch, or ¾ inch weights 256 are used in the aft balancing holes 243, and ¼ inch or ½ inch weights 256 are used in the forward balancing holes 242. In another embodiment steps 511 and 512 only use the aft balancing holes 243 to balance the forward weldment 231.

Balancing the compressor rotor assembly 230 may also include step 513, fastening the forward weldment 231 to the aft weldment 232. Fastening the forward weldment 231 to the aft weldment 232 may include installing a fastener, such as a bolt, in each forward weldment mounting hole 227 and in the corresponding aft weldment mounting hole 228.

Balancing the compressor rotor assembly 230 may also include step 514, measuring the rotational balance or imbalance of the compressor rotor assembly 230 with a balancing machine. Step 514 may be followed by step 515, weighing the plurality of airfoils 235 that may be part of the compressor rotor assembly 230. The airfoils 235 may vary in weight due to possible manufacturing limitations. Balancing the compressor rotor assembly 230 may also include step 516, determining the number of weights 256, the sized of each weight 256, the desired location for each of the determined weights 256 based upon the measured rotational balance of the compressor rotor assembly 230, and the desired slot 247 to receive each airfoil based upon the measured rotational balance of the compressor rotor assembly 230. The group of balancing holes not used in the first balancing operation may be used. Step 516 may be accomplished using the balancing machine. The balancing machine may determine the parameters of step 516 based on the compressor rotor assembly 230 imbalance, the weight of each airfoil 235, the available weights 256, and the available locations of the weights 256 and airfoils 235.

Balancing the compressor rotor assembly 230 may also include step 517, mounting each weight 256 in the determined location. In one embodiment ¼ inch, ½ inch, or ¾ inch weights 256 are used in the aft balancing holes 243, and ¼ inch or ½ inch weights 256 are used in the forward balancing holes 242. In another embodiment steps 516 and 517 only use the forward balancing holes 242 to balance the compressor rotor assembly 230. Balancing the compressor rotor assembly 230 may further include step 518, mounting each airfoil 235 in the determined slot.

Balancing the compressor rotor assembly 230 may also include balancing the first stage compressor disk 221 prior to the first stage compressor disk 221 being welded to forward weldment 231. Balancing the first stage compressor disk 221 may include measuring the rotational balance or imbalance of the first stage compressor disk 221 with a balancing machine. Balancing the first stage compressor disk 221 may also include determining the number of weights 256, the size of each weight 256, and desired location for each of the determined weights 256 based upon the measured rotational balance of the first stage compressor disk 221. The location for each weight 256 may be in a forward balancing hole 242 or in an aft balancing hole 243. Either the first group of balancing holes or the second group of balancing holes may be used. Balancing the first stage compressor disk 221 may further include mounting each weight 256 in the determined location. In one embodiment ¼ inch, ½ inch, or ¾ inch weights 256 are used in the aft balancing holes 243, and ¼ inch or ½ inch weights 256 are used in the forward balancing holes 242. In another embodiment only the aft balancing holes 243 are used to balance the first stage compressor disk 221. Balancing the first stage compressor disk 221 may replace steps 510-512.

In addition, balancing the compressor rotor assembly 230 may include measuring the balance of the compressor rotor assembly 230 under operating conditions. After the gas turbine engine is built up, the gas turbine engine may be operated and tested. The testing may include measuring the balance or imbalance of the compressor rotor assembly 230. The compressor rotor assembly 230 may need to be trim balanced to account for the imbalance of the compressor rotor assembly 230. Trim balancing the compressor rotor assembly 230 may include determining the number of weights 256, the size of each weight 256, and location for each of the determined weights 256 based upon the measured rotational balance of the compressor rotor assembly 230. The location for each weight 256 may be in a forward balancing hole 242 or in an aft balancing hole 243. Trim balancing the compressor rotor assembly 230 may also include mounting each weight 256 in the determined location. In one embodiment ¼ inch, ½ inch, or ¾ inch weights 256 are used in the aft balancing holes 243, and ¼ inch or ½ inch weights 256 are used in the forward balancing holes 242. In another embodiment only the forward balancing holes 242 are used to trim balance the compressor rotor assembly 230.

Balancing the compressor rotor assembly 230 may comprise one or more balancing operations using the balancing system 255. A first balancing operation may comprise Steps 510-512. A second balancing operation may comprise steps 514-517. A third balancing operation may comprise balancing the first stage compressor disk 221. Alternatively balancing the first stage compressor disk 221 may replace steps 510-512 in the first balancing operation. A fourth balancing operation may comprise measuring the balance of the compressor rotor assembly 230 under operating conditions and trim balancing the compressor rotor assembly 230.

The preceding detailed description is merely exemplary in nature and is not intended to limit the invention or the application and uses of the invention. The described embodiments are not limited to use in conjunction with a particular type of gas turbine engine. Hence, although the present disclosure, for convenience of explanation, depicts and describes a particular first stage compressor disk, a particular forward weldment, a particular aft weldment, and associated processes, it will be appreciated that other first stage compressor disks, forward weldments, aft weldments, and processes in accordance with this disclosure can be implemented in various other compressor rotor assemblies, configurations, and types of machines. Furthermore, there is no intention to be bound by any theory presented in the preceding background or detailed description. It is also understood that the illustrations may include exaggerated dimensions to better illustrate the referenced items shown, and are not consider limiting unless expressly stated as such.

What is claimed is:

1. A first stage compressor disk of a gas turbine engine configured for balancing a compressor rotor assembly, the first stage compressor disk comprising:

a body having a forward end, an aft end, an outer surface, a plurality of forward balancing holes extending through the outer surface and aligned circumferentially about the body, and a plurality of aft balancing holes extending through the outer surface, aligned circumferentially about the body, and located aft of the forward balancing holes; and a radial flange extending radially outward from the body and including slots for mounting first stage airfoils, the slots for mounting the first stage airfoils being disposed downstream of both the plurality of forward balancing holes and the plurality of aft balancing holes along a flow direction extending from the forward end of the body toward the aft end of the body.

2. The first stage compressor disk of claim 1, wherein the aft balancing holes are circumferentially offset from the forward balancing holes.

3. The first stage compressor disk of claim 2, wherein a total number of the forward balancing holes is between 12 and 30, a total number of the aft balancing holes is between 12 and 30, and the aft balancing holes are circumferentially offset from the forward balancing holes by half of the angular distance between adjacent forward balancing holes.

4. The first stage compressor disk of claim 2, wherein a total number of the forward balancing holes is 24, a total number of the aft balancing holes is 24, and the aft balancing holes are circumferentially offset from the forward balancing holes by 7.5 degrees.

5. The first stage compressor disk of claim 1, wherein the body has an outer axial flange, the outer axial flange including a forward surface, and a plurality of hub mounting holes, at least a portion of the outer surface is disposed on the outer flange and the forward surface is adjacent to the outer surface, the radial flange extends radially outward from the aft end of the body, and an aft welding member with an annular shape extends axially aft from the aft end of the body.

6. The first stage compressor disk of claim 1, wherein the aft balancing holes are at least 0.75 inches deep.

7. A compressor rotor assembly of a gas turbine engine, the compressor rotor assembly comprising:

a forward weldment having a plurality of forward compressor disks including a first stage compressor disk having a body including a forward end, an aft end, an outer surface, a plurality of forward balancing holes through the outer surface and distributed circumferentially about the body, a plurality of aft balancing holes through the outer surface, distributed circumferentially about the body, and located aft of the forward balancing holes, and a radial flange extending radially outward from the body and including slots for mounting first stage airfoils, the slots for mounting the first stage airfoils being disposed downstream of both the plurality of forward balancing holes and the plurality of aft balancing holes along a flow direction extending from the forward end of the body toward the aft end of the body; and an aft weldment having a plurality of aft compressor disks, wherein each compressor disk of the plurality of forward compressor disks is welded to another compressor disk of the plurality of forward compressor disks, wherein each compressor disk of the plurality of aft compressor disks is welded to another compressor disk of the plurality of aft compressor disks, and wherein the forward weldment is fastened to the aft weldment.

8. The compressor rotor assembly of claim 7, wherein the aft balancing holes are circumferentially offset from the forward balancing holes.

9. The compressor rotor assembly of claim 8, wherein a total number of the forward balancing holes is between 12 and 30, a total number of the aft balancing holes is between 12 and 30, and the aft balancing holes are circumferentially offset from the forward balancing holes by half of the angular distance between adjacent forward balancing holes.

10. The compressor rotor assembly of claim 8, wherein a total number of the forward balancing holes is 24, a total number of the aft balancing holes is 24, and the aft balancing holes are circumferentially offset from the forward balancing holes by 7.5 degrees.

11. The compressor rotor assembly of claim 7, wherein the body has an outer axial flange, the outer axial flange including a forward surface, and a plurality of hub mounting holes, at least a portion of the outer surface is disposed on the outer axial flange and the forward surface is adjacent to the outer surface, the radial flange extends radially outward from the aft end of the body, and an aft welding member with an annular shape extends axially aft from the aft end of the body.

12. The compressor rotor assembly of claim 7, wherein the aft balancing holes are at least 0.75 inches deep.

13. A method for balancing a compressor rotor assembly of a gas turbine engine, the compressor rotor assembly having compressor disks defining slots for mounting a plurality of airfoils, the compressor disks including a first stage compressor disk having a body with an outer surface, a balancing system including a plurality of forward balancing holes extending through the outer surface and distributed circumferentially about the body, a plurality of aft balancing holes extending through the outer surface and distributed circumferentially about the body, the aft balancing holes being located aft of the forward balancing holes, and the plurality of forward balancing holes and the plurality of aft balancing holes being disposed upstream of the slots for mounting the plurality of airfoils along an axial flow direction through the compressor rotor assembly, the method comprising:

measuring a rotational balance of a forward weldment, the forward weldment comprising a first plurality of compressor disks that are welded together;

determining a number of weights in a first group of weights, a size of each weight in the first group of weights, and a desired location within the balancing system for each weight of the first group of weights based upon the measured rotational balance of the forward weldment;

mounting each weight of the first group of weights in a corresponding desired location;

fastening the forward weldment to an aft weldment, the aft weldment comprising a second plurality of compressor disks that are welded together;

measuring a rotational balance of the compressor rotor assembly;

weighing each airfoil in the plurality of airfoils;

determining a number of weights in a second group of weights, a size of each weight in the second group of weights, and a desired location in the balancing system for each weight of the second group of weights based upon the measured rotational balance of the compressor rotor assembly;

determining a desired slot to receive each airfoil of the plurality of airfoils based upon the measured rotational balance of the compressor rotor assembly;

mounting each weight of the second group of weights in a corresponding determined location; and mounting each airfoil of the plurality of airfoils in a corresponding determined slot.

14. The method of claim 13, wherein the location for each weight of the first group of weights is selected from the aft balancing holes, and the location for each weight of the second group of weights is selected from the forward balancing holes.

15. The method of claim 13, wherein the first stage compressor disk is welded to the forward weldment after the measuring the rotational balance of the first stage compressor disk, the determining the number of weights in the first group of weights, the size of each weight in the first group of weights, and the desired location in the balancing system for each weight of the first group of weights based upon the measured rotational balance of the first stage compressor disk, and the mounting each weight of the first group of weights in the corresponding determined location.

16. The method of claim 15, wherein the location for each weight of the first group of weights is selected from the aft balancing holes.

17. The method of claim 15, wherein ¼ inch, ½ inch, and ¾ inch weights are used in the aft balancing holes.

18. The method of claim 13, wherein ¼ inch, ½ inch, and ¾ inch weights are used in the aft balancing holes and ¼ inch and ½ inch weights are used in the forward balancing holes.

19. The method of claim 13, further comprising:

measuring the compressor rotor assembly balance under operating conditions; and trim balancing the compressor rotor assembly.

20. The method of claim 19, wherein weights are only mounted in the forward balancing holes for the trim balancing the compressor rotor assembly.

* * * * *